United States Patent [19]

Rudolph et al.

[11] 4,357,870

[45] Nov. 9, 1982

[54] DRIVING MECHANISM FOR GROUPS OF ADJUSTABLE SHEET-GRIPPING ELEMENTS IN A TRANSFER CYLINDER OF A SHEET-FED PRINTING MACHINE

[75] Inventors: Otfried Rudolph, Dresden; Gunter Peter; Karlheinz Fischer, both of Coswig, all of German Democratic Rep.

[73] Assignee: VEB Kombinat Polygraph "Werner Lamberz" Leipzig, Leipzig, German Democratic Rep.

[21] Appl. No.: 283,672

[22] Filed: Jul. 15, 1981

[30] Foreign Application Priority Data

Jun. 30, 1980 [DD] German Democratic Rep. ... 222245

[51] Int. Cl.[3] ..... B41F 21/00

[52] U.S. Cl. ..... 101/246; 101/409; 271/82; 271/276; 271/277

[58] Field of Search ..... 101/246, 409, 410–411, 101/232, 415.1, 230; 271/65, 82, 94, 276, 277

[56] References Cited

U.S. PATENT DOCUMENTS

| | | | |
|---|---|---|---|
| 3,414,259 | 12/1968 | Koch et al. | 101/409 |
| 3,654,861 | 4/1972 | Rudolph et al. | 101/230 X |
| 3,899,970 | 8/1975 | Jurny et al. | 101/409 X |
| 3,937,142 | 2/1976 | Cerny et al. | 101/409 |
| 4,029,009 | 6/1977 | Kuhn et al. | 101/232 X |
| 4,133,263 | 1/1979 | Schilling | 101/409 |
| 4,233,899 | 11/1980 | Rebel | 101/246 |

FOREIGN PATENT DOCUMENTS

| | | | |
|---|---|---|---|
| 627336 | 9/1961 | Canada | 101/409 |
| 2045213 | 10/1980 | Fed. Rep. of Germany | 101/409 |
| 55-48004 | 4/1980 | Japan | 101/409 |
| 917781 | 2/1963 | United Kingdom | 101/409 |

*Primary Examiner*—E. H. Eickholt

*Attorney, Agent, or Firm*—Michael J. Striker

[57] ABSTRACT

A driving mechanism for groups of operating elements arranged in a rotary sheet guiding cylinder of a sheet-fed printing machine includes a pair of control shafts arranged in the guiding cylinder parallel to its axis of rotation and being driven by transmission gears arranged in the cylinder, two sets of cams, each supported on an assigned control shaft for activating a group of operating elements in a selected operational mode of the machine, and clutch means provided between the transmission gears and the shafts and operated from one point to actuate one control shaft and deactivate the other control shaft.

13 Claims, 9 Drawing Figures

DRIVING MECHANISM FOR GROUPS OF ADJUSTABLE SHEET-GRIPPING ELEMENTS IN A TRANSFER CYLINDER OF A SHEET-FED PRINTING MACHINE

BACKGROUND OF THE INVENTION

The present invention relates in general to sheet-fed printing machines and in particular to a driving mechanism for groups of adjustable sheet-gripping elements arranged in a rotary sheet transfer cylinder of a sheet-fed printing machine which is switchable for printing in one of two operational modes such as printing on one side of the sheet only, that is the first form mode, or printing on both sides of the sheet when the sheet is first printed on one side and thereupon is turned over around its rear edge and printed on its back.

Driving mechanisms for groups of gripping elements in a sheet transfer cylinder of sheet-fed rotary printing machines in which the desired movement of the gripping elements is derived from sets of cam drives, are known from prior art. For example, German patent No. 1,107,266 discloses an arrangement in which the movement of swing shafts is controlled by a cam having a cam shaft supporting an arm with a cam follower which rolls on the inner side of the cam and transmits its motion to a toothed segment, wherefrom the movement is transmitted to a cam gear mounted on the swing shaft. The cam is arranged at one side of the transfer cylinder. The movement of grippers is also controlled by a cam arranged at the opposite side of the machine.

In another embodiment of prior-art driving mechanisms of this type, such as disclosed in DL patent No. 59 799, the control of swinging movement is accomplished by means of a roll following the outer surface of a cam.

A common feature of all known driving mechanisms for groups of functional elements in sheet-guiding cylinders, particularly in turnover cylinders, is the fact that the control cams are arranged on a side wall of the printing machine concentrically relative to the axis of rotation of the sheet-guiding cylinder. As a consequence of this concentric arrangement of the cams, the size of the latter has to be designed relatively large and the cams must be mounted on special holders.

Another disadvantage of this prior-art arrangement resides in the fact that, during the assembly of the driving mechanisms for turnover cylinders, the mounting of such cams and cam holders can be effected only after the insertion and angular displacement of the shafts of the turnover cylinder into its bearing openings. For this reason, the cams and the cam holders as a rule have to be constructed of several parts and consequently high manufacturing and installation costs result.

In switching over the mode of operation of the machine, that is, in adjusting the machine from printing on one side only to printing on both sides of the sheet, and vice versa, it is necessary that the functional groups on the sheet transfer cylinders be adjusted also to the selected operational mode, that is, some of the functional groups must be brought to a neutral position or to an active position or to a reverse operational position. According to the German patent No. 1,107,246 this position adjustment is accomplished by exchanging the cam disks, that is by removing one set of disks and inserting another set.

In another known embodiment, such as for example in the DL patent No. 83 576 and in the German Published patent application No. 2,419,747, the cams for the selected functional group are coupled together and thus can be replaced as a pack when the machine is switched over to another operational mode; nonetheless, it is still necessary to readjust additional functional groups of the turnover cylinder depending on the particular arrangement of its cams.

Also in this prior-art solution, the existence of a large number of driving means necessitating separate adjustment of respective functional groups increases the proportion of manual attendance which is further increased due to the locally different arrangement of the drives (at both side disks of the turnover cylinder) and also contributes to an enlarged width of the printing machine.

Due to the large number of necessary adjusting steps, the prior-art printing machines are therefore prone to adjustment errors which may cause degradation of the function and even damage to the printing machine.

SUMMARY OF THE INVENTION

It is therefore a general object of the present invention to overcome the aforementioned disadvantages.

More particularly, it is an object of the this invention to provide an improved driving mechanism for functional groups in a sheet-guiding cylinder of a sheet-fed printing machine which is capable of being switched over from one operational mode to another operational mode, and vice versa, in a simple manner and in shorter time.

Another object of this invention is to provide such an improved driving mechanism which eliminates the possibility of an adjustment error of the functional groups when a switchover between the operational modes of the machine takes place.

A further object of the invention is to provide such an improved driving mechanism which enables the design of a printing machine which has a reduced width.

An additional object of the invention is to provide a driving mechanism which results in an improved access to the control points during the switchover of the operational mode of the machine from printing on one side only to printing on the one side and on the back.

In keeping with these objects and others which will become apparent hereafter, one feature of the invention resides, in a sheet-fed printing machine which is switchable for printing on one side of the sheet or on both sides of the sheet and having a sheet transfer or guiding cylinder provided with groups of functional elements arranged between the side disk of the cylinder, in the provision of two shafts arranged between the side disks parallel to each other and to the axis of rotation of the sheet guiding cylinder, a first set of cams supported on one of the shafts for driving the groups of functional elements in one operational mode, a second set of cams supported on the other shaft for driving the groups of functional elements in the other operational mode, and clutch means provided between the two shafts and transmission gears in the guiding cylinder to activate a selected set of the cams.

The clutch means can be arranged in the sheet guiding cylinder or concentrically to the axle of the sheet guiding cylinder. In a modification, the coupling can be arranged off the side disks of the cylinder eccentrically to its axis of rotation.

Furthermore, there is provided an adjustment shaft for shifting the clutch. The adjustment shaft supports a carrier for engaging a clutch coupling sleeve by means of which the grippers on a gripper shafts are assigned via a coupler to a first or to a second control cam.

On one control shafts (SW) are arranged the following components: sheet transfer control cam for controlling the suction-type and gripper-type transfer elements, a control cam for controlling the underpressure in the suction-type transfer elements, a segment controlling cam for controlling the guiding segments, and a first gripper control cam for controlling the grippers during the printing on both sides of the sheet. On the other control shaft (S) there is arranged a second gripper control cam for controlling the grippers in printing on one side of the sheet only.

There is also provided a second adjustment shaft coupled to the first adjustment shaft by a gear train.

Due to the fact that the driving mechanism for respective functional groups in the sheet transfer cylinder of a printing machine includes means which are separately driven for respective modes of printing operation, namely for printing on one side of the sheet only and for printing on both sides of the sheet, the printing machine can be designed with reduced width and with an improved accessibility to the control station for switching over the mode of operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
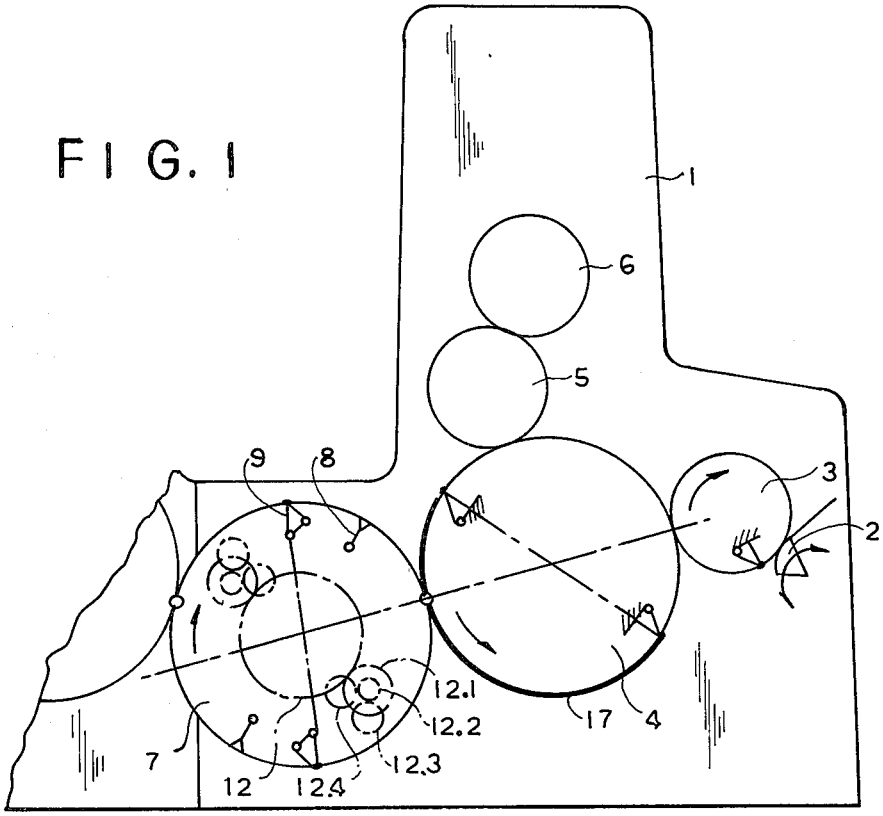
FIG. 1 is a schematic side view of a letterpress or relief press of a sheet-fed printing machine.

Referring firstly to FIG. 1, a relief cylinder press 1 of a sheet-fed printing machine includes a sheet transfer mechanism 2, a feeding cylinder 3, an impression cylinder 4, a rubber cylinder 5, a plate cylinder 6, and a sheet guiding cylinder 7. Two diametrally opposed suction-type and gripper-type transfer elements 8 and 9 are arranged on the guiding cylinder 7 forming a group or system of sheet transfer elements.

In the following description the arrangement and operation of only one correlated suction and gripper system 8 and 9 will be described.

Figure 2:
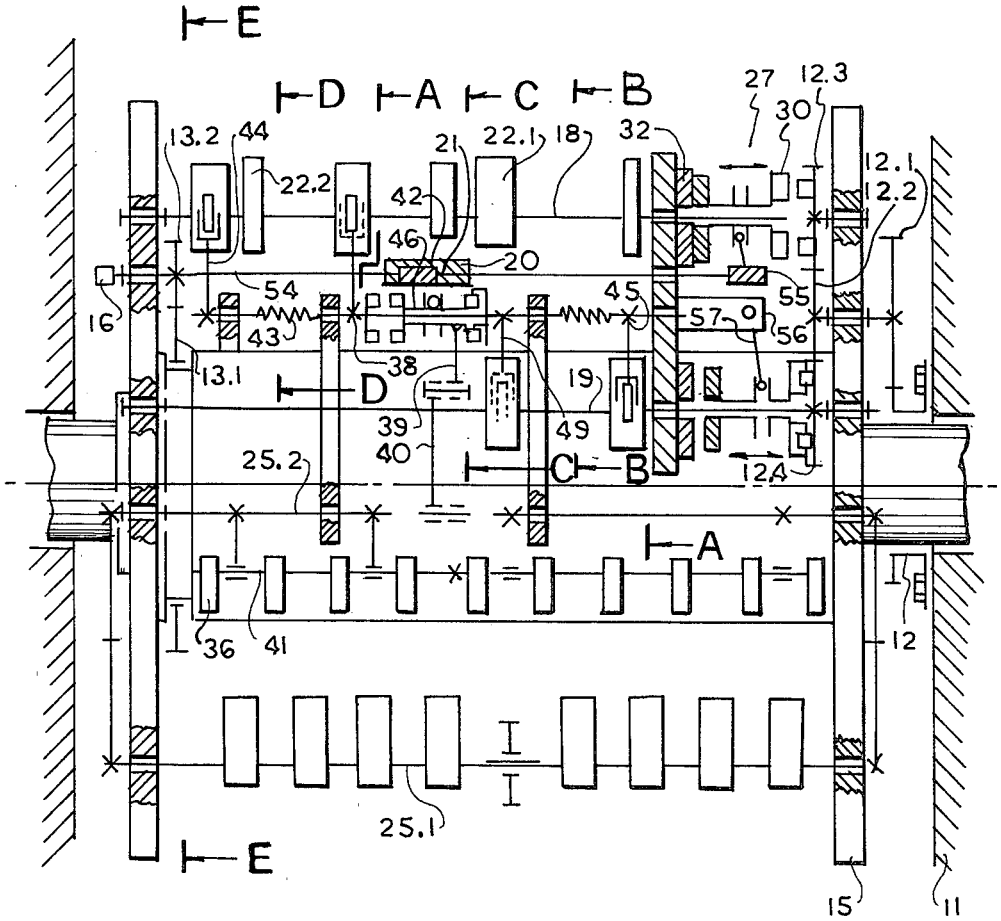
FIG. 2 is a simplified top view, partly in section, of a sheet guiding cylinder.

A spur gear 12 is fixed to a side frame 11 of the machine coaxially with the axle 10 (FIG. 2) of the sheet guiding cylinder 7, and the gear 12 permanently engages a gear 12.1 supported for rotation in the outer side disk 15 of the guiding cylinder 7. A transmission gear 12.2 arranged at the inner surface of the outer disk 15 is connected to the gear 12.1 and engages transmission gears 12.3 and 12.4 acting as driving elements for control shafts 18 and 19 the operation of which will be explained below.

The transmission ratio between the gears 12 to 12.4 in this exemplary embodiment is set with advantage in such a manner that, on rotating the guiding cylinder 7 about 360°, the control shafts 18 and 19 rotate also about 360°.

Figure 4:
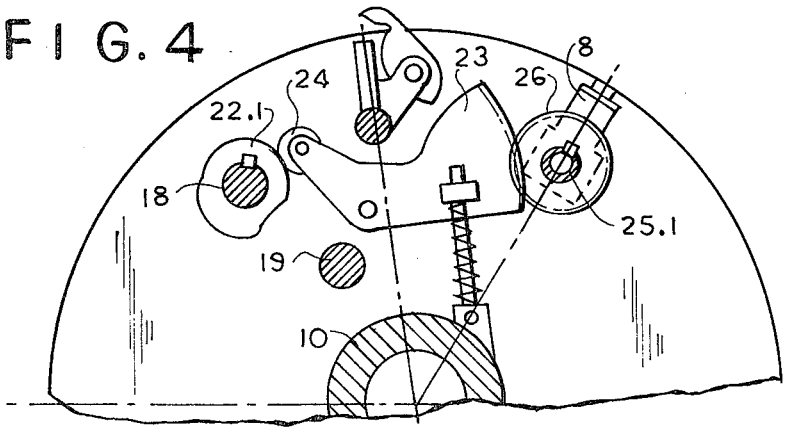
FIG. 4 is a side view of a cut away part of the sheet guiding cylinder taken along the line B—B in FIG. 2 and showing driving means for a group of sheet transfer elements according to this invention.
Figure 7:
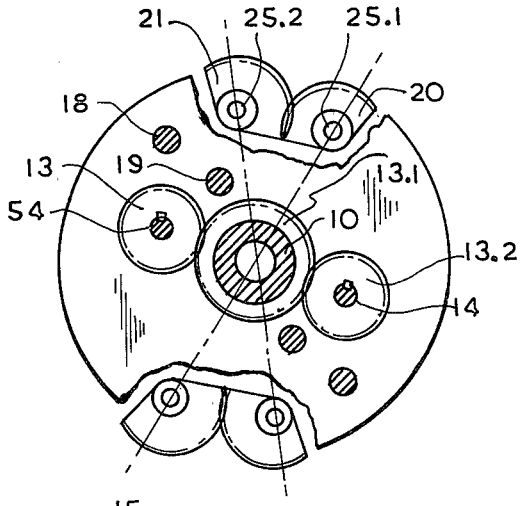
FIG. 7 shows the arrangement of two adjustment shafts in the guiding cylinder of FIG. 2, taken along the line E—E.

The first control shaft 18 is selectively operated for switching the printing machine for an operational mode SW at which both sides of the sheet are printed. The shaft 18 supports cams 22 for controlling the necessary motions of all functional groups of transfer elements on the guiding cylinder 7 assigned for the aforementioned mode of printing both on the front side and on the back of the sheet. The oscillatory movement of the functional elements is carried out in a conventional manner (DD patent No. 59,799) by means of gear segments 20 and 21 (FIG. 7) arranged respectively on oscillating shafts 25.1 and 25.2. The gear segments 20 and 21 control the interconnected suction-type and gripper-type transfer elements 8 and 9 by means of transfer control cam 22.1 (FIG. 4) as a function of angle of rotation of the sheet guiding cylinder 7.

Figure 5:
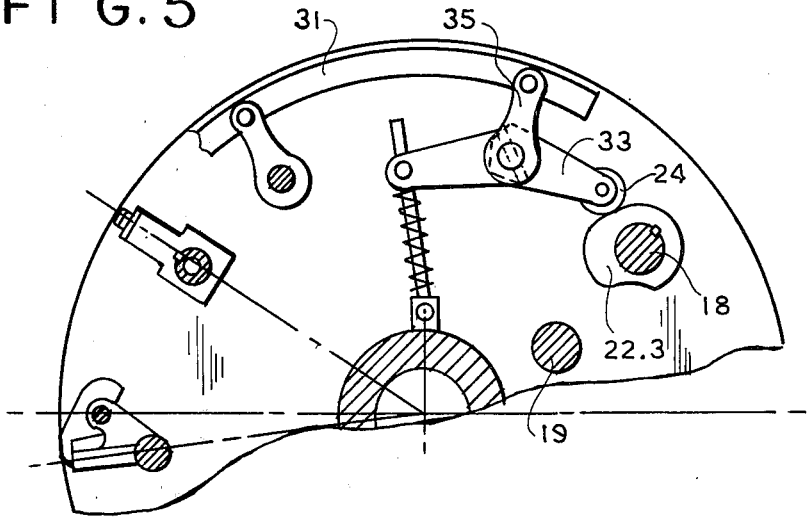
FIG. 5 shows in a side view a cut away part of the guiding cylinder, taken along the line C—C in FIG. 2 and showing the sheet guiding means.
Figure 6:
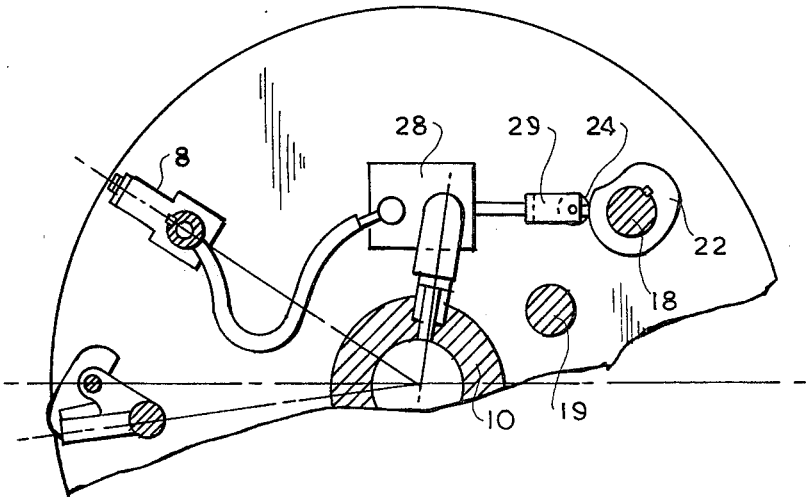
FIG. 6 shows in a side view a cut away part of the cylinder according to FIG. 2, taken along the line D—D and showing control means for suction air.

A two-arm rocking lever 23 carries at one arm thereof a cam-follower roller 24 and at the other arm is formed with a gear segment which is in mesh with a spur gear 26 connected to a swing shaft 25.1. Underpressure in suction-transfer elements 8 is controlled by a control cam 22.2 (FIG. 6). In this exemplary embodiment the guiding cylinder 7 contains two conventional control valves 28 diametrically opposed relative to the axle 10. The movement of plunger 29 for respective valves 28 is controlled by a cam 22.2. The movement of guiding segments 31 is controlled by cam-follower roller 24' and by a control cam 22.3. A rocking lever 33 transmits in a manner known from the DD patent No. 76,684 the movement of the cam-follower roller 24' to an arm 35 which is linked to the guiding segment 31 (FIG. 5).

Figure 3:
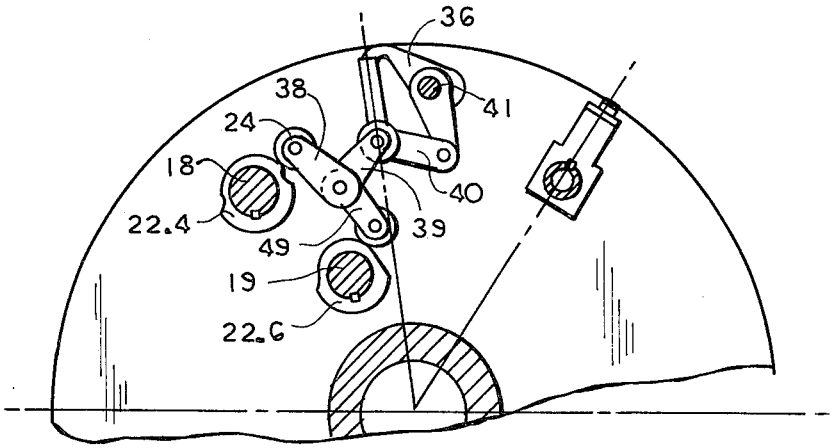
FIG. 3 is a side view of a cut away part of the cylinder of FIG. 2 taken along the line A—A and showing schematically control means for sheet grippers.

The movement of grippers 36 in the SW mode of operation of the printing machine is controlled by a first gripper control cam 22.4 (FIG. 3). Movement of the cam-follower lever 38 is transmitted to the gripper 36 via a one-arm lever 39, a coupler 40 which is linked to an arm fixed to the shaft 41 of the gripper 36. A torsion bar spring 43 (FIG. 2) adjusts the force lock between the cam-follower roller 24 and the gripper control cam 22.4. The tension of the torsional spring bar 43 is held constant by an equalizing gear train 44.

On the other control shaft 19 for the S mode of operation of the printing machine, cams 22 for controlling the successive movements of the functional groups of transfer elements on the cylinder 7 are arranged which become effective when the machine is switched over for printing on one side of the sheets only. Inasmuch as in the one-side mode of operation of the machine only the movement of gripper 36 is to be controlled, the control shaft 19 is provided with a second gripper control cam 22.5 (FIG. 3). The movement of the second cam-follower lever 49 is transmitted via lever 39, the coupler 40, and the gripper shaft 41 to the gripper 36. A second equalization gear train 45 keeps the tension of the torsion spring bar 43 at a constant value.

An adjustment shaft 54 passing through the inner side disk of the guiding cylinder 7 supports a worm 55 engaging a worm gear 56 supported for rotation in the guiding cylinder 7. A two-arm lever is secured for joint rotation to the worm gear 56 and the free ends of the lever 57 engages clutch rings of clutch means 27 movable on respective control shafts 18 and 19. Each clutch ring is provided with coupling claws 30 engageable with corresponding claws on driving gears 12.2 and 12.3 and at the other end with braking lining 32.

In addition, adjustment shaft 54 supports a screw wheel 42 which is in engagement with a toothed rack 20 and by means of a carrier 21 is coupled to a clutch coupling sleeve 46.

A second gear 13 fixed on the adjustment shaft 54 engages a gear 30.1 arranged for rotation coaxially to the axis of rotation of the axle 10 and being in mesh with another gear 13.2. The gear 13.2 is arranged on a second adjustment shaft 14 and its design is the same as that of the first adjustment shaft 54 and for this reason is not illustrated in detail.

The clutch coupling sleeve 46 is operated by an adjustment control knob 16 attached at the projecting end of the adjustment shaft 54, and this single control knob thus activates double systems of functional elements on the driving cylinder 7.

The aforedescribed device operates as follows:

Sheets 17 are fed via sheet transfer mechanism 2 and the feeding cylinder 3 on impression cylinder 4 where they are printed. In the one-side mode of operation (S) sheet 17 is seized at its leading edge by grippers 36 on guiding cylinder 7 and transferred to the subsequent printing press. In the other operational mode, when the sheets are printed on both sides, the sheet 17 is seized at its trailing edge by suction-type transfer elements 8 on the guiding cylinder 7 and transferred to the grippers 36.

In switching over from one operational mode to the other, for example in switching from one-side printing to printing on both sides of the sheet, and vice versa, the adjustment knob 16 is operated so that adjustment shaft 54 by means of worm 55 rotates the worm gear 56 and thus the two-arm lever 57 to a position in which clutch rings 27 on respective control shafts 18 and 19 are brought into or out of engagement with respective driving gears 12.3 or 12.4.

As mentioned before, the coupling of such rings 27 with the driving gears 12.3 or 12.4 is effected by claws 30 provided both on clutch rings 27 and on driving gears at such locations that the coupling can occur only at predetermined angular positions of the sheet guiding cylinder.

In the disengaged position of one of the clutch rings 27, one of the assigned control shaft 18 or 19 is arrested by the application of braking lining 32 against a partition in the cylinder 7.

Simultaneously with the actuation of knob 16 carrier 21 displaces the coupling sleeve 46, thus causing via the coupler 40 and the one-arm lever 39 the switchover of grippers 36 on the gripper shaft 41 to the selected control shaft 22.4 or 22.5.

The arrangement according to this invention brings about the advantage that the cams 22 for controlling the movements of functional groups provided in the sheet guiding cylinder 7 for each mode of operation SW or S of the printing machine, can be combined on the two control shafts 18 and 19 arranged within the limits of the side disks 15 of the guiding cylinder 7.

In other words, the cams 22 are no longer arranged in conventional manner in the region between the outer surface of side disks 15 and the inner surface of the machine frame 11, concentrically to the axle 10 of the guiding cylinder 7, but are arranged inside the guiding cylinder and consequently the size of the cams 22 in the arrangement of this invention can be substantially reduced in comparison with prior art. Accordingly, due to the reduced size of the cams 22, apart from saving of material, the manufacturing costs and the installation problems incumbent on conventional divided cams 22 arranged around the axle 10 of the guiding cylinder, are thus substantially reduced. Moreover, the arrangement of this invention considerably facilitates the assembly and installation of the sheet guiding cylinder 7 and also makes easier the adjustment of all groups of functional elements and of their driving means.

All adjustments of the functional groups of elements for the grippers and their drives, by virtue of this invention, can with advantage be made while the sheet guiding cylinder is standing still, for example when the latter stands in an assembly jig, because the motions of the groups of functional elements in a stationary guiding cylinder 7 can be attuned to each other by rotating the control shafts 18 and 19 only.

The adjustments can be carried out for instance by directly rotating the control shafts 18 and 19 while the guiding cylinder is stationary, whereby spur gears 12.3 and 12.4 are kept out of engagement with gear 12.2 until the adjustment is completed. Each of the control shafts 18 and 19 in the assembly jig can be rotated independently from the other. Upon the completion of the adjustment in the assembly jig, the guiding cylinder 7 is inserted into its bearing bores in the frame walls 11 and can be finally installed without any disassembly of construction parts of the machine. The trouble-free installation is made possible by the arrangement of whole functional groups of elements and their drives in the space between the side disks 15 of the guiding cylinder, whereas the space between the side disks 15 and the frame 11 remains free.

Also, the simplification of the switching operation of the printing machine when changing the operational mode results from the fact that, due to the concentration of cams 22 on respective control shafts 18 and 19 and due to the provision of clutch means 27 operable via the adjustment shaft 54 from a single control point by activating the setting knob 16, all drives assigned to the selected groups of functional elements are simultaneously activated while the non-selected group of elements is rendered ineffective.

As a consequence, in the switchover to another operational mode, the separate handling of individual groups of elements which, depending on the spatial arrangement of these elements, required the positioning of the guiding cylinder for the sake of accessibility, can be dispensed with during the switching of the operational mode.

In contrast to prior-art designs where a large number of adjustment steps usually performed in a prescribed order was necessary, thus making the machine susceptible to human error, the arrangement of this invention eliminates any possibility of misadjustment. Furthermore, the clutch means in the arrangement of this invention can be connected with an electric safety device in such a manner that during the switching of the operational mode the printing machine cannot be energized, and in this manner the operational safety during the switchover period is increased.

Also, time required for completing the switchover from one operational mode to another is substantially reduced by this invention, and the saved time can be added to the productive time.

Figure 8:
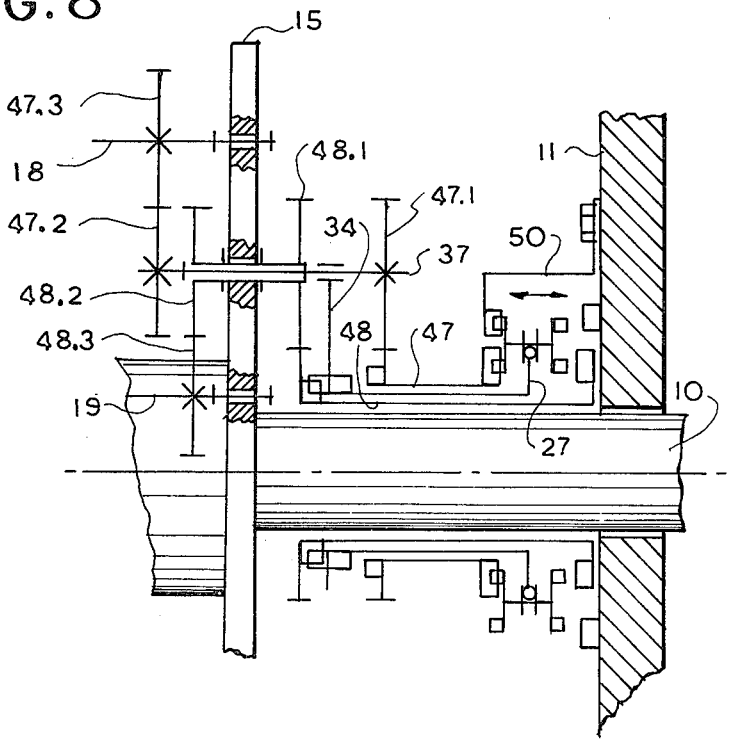
FIG. 8 shows in a schematic top view another embodiment of the driving mechanism for control shafts according to this invention.

Another advantageous modification of the driving arrangement of this invention is illustrated in FIG. 8. In this embodiment, the clutch 27 is arranged between a disk 15 of the guiding cylinder and the inner wall of frame 11 of the machine. The section of axle 10 between the frame 11 and the side disk 15 supports a central gear 47 for the SW mode of operation, and a coaxially arranged gear 48 for the S mode of operation and the two coaxial gears are coupled to the clutch 27. For this purpose, a coupling ring 50 is fastened by screws to the inner wall of frame 11 around the axle 10. The central gear 47 is in mesh with a gear train 47.1 and 47.2 which engages a gear 47.3 mounted on the control shaft 18 for the SW mode of operation.

The other central gear 48 is in mesh with a train of gears 48.1 and 48.2 which engage a gear 48.3 mounted on the other control shaft 19 for the S mode of operation. A binder 34 is slidably guided on a shaft 37 connecting the gears 47.1 and 47.2 and at its other end is connected to the clutch 27. As illustrated in FIG. 8, the clutch 27 is in a position in which the control shaft 18 for the SW mode of operation is activated. At the same time, in this illustrated position the central gear 48 is locked by the binder 34 on the guiding cylinder 7, and consequently the other control shaft 19 is stationary relative to the guiding cylinder 7. In the S mode of operation for printing on one side of the sheet only, the kinematic conditions are reversed, that is, upon shifting the coupling 27 in the other position the binder 34 is shifted to arrest the central gear 47 against the guiding cylinder 7. The central gear 48 is braked by the clutch 27 against the inner wall of the frame 11.

Figure 9:
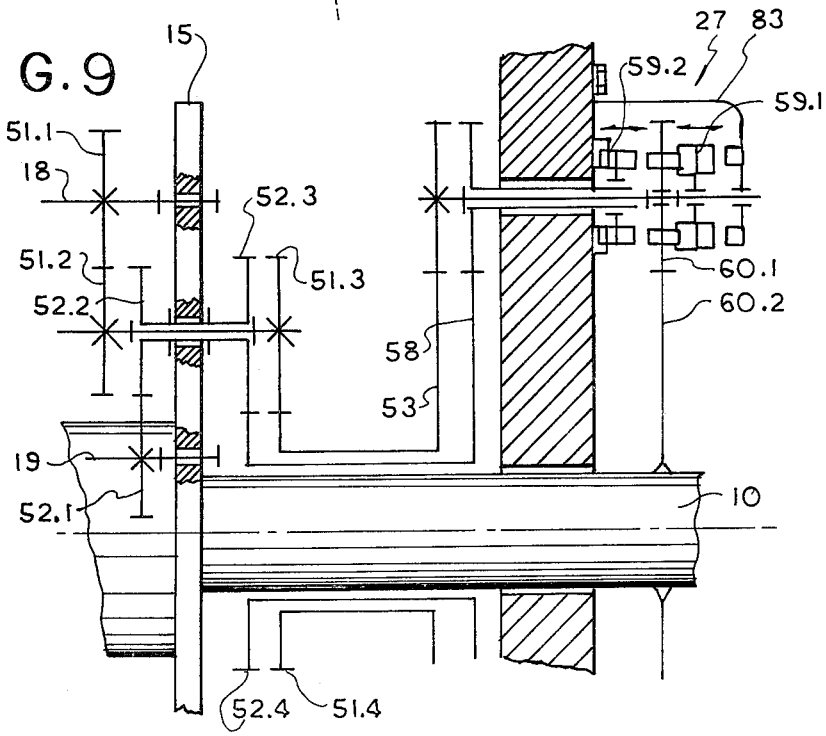
FIG. 9 is still another embodiment of the driving mechanism for control shafts of this invention.

In another embodiment according to FIG. 9, the clutch 27 is arranged apart from the guiding cylinder 7 and eccentrically to its axle 10 in such a manner that the switchover of the machine from one operational mode to the other can be made from outside without opening the machine cover. In this embodiment control shaft 18 for SW mode of operation is driven by means of a gear train 51 consisting of gears 51.1, 51.2, 51.3 and 51.4 or by means of a second gear train 52 consisting of gears 52.1, 52.2, 52.3 and 52.4 and coupled via a first pair of gears 53 or via a second pair of gears 58, according to the position of clutch disks 59.1 and 59.2, with a third pair of gears 60 consisting of gears 60.1 and 60.2, or is braked against the frame wall 11. In the coupling position illustrated in FIG. 9, control shaft 18 for the SW mode of operation is connected to the axle 10 of the guiding cylinder 7, and consequently during the rotation of guiding cylinder 7 the relative position of the shaft 18 is stationary relative to the cylinder 7, whereas the other control shaft 19 for the S mode of operation, due to the gear train 60 which is stationary relative to the frame wall 11, rotates during the rotation of the guiding cylinder 7.

It will be understood that each of the elements described above, or two or more together, may also find a useful application in other types of constructions differing from the types described above.

While the invention has been illustrated and described as embodied in specific examples of the driving mechanism for the functional groups of elements of a turnover or guiding cylinder of a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A driving mechanism for groups of gripping elements arranged in a rotary sheet guiding cylinder of a sheet-fed printing machine which is switchable for selecting one of two operational modes such as printing on one side of the sheet only or printing on both sides of the sheet, said driving mechanism comprising transmission gears supported for rotation in said guiding cylinder; two control shafts arranged in said guiding cylinder for rotation parallel to the axis of rotation of said guiding cylinder; a first set of cams mounted on one of said control shafts for driving said groups of gripping elements in one operational mode; a second set of cams mounted on the other control shaft for driving said groups of gripping elements in the other operational mode; and clutch means arranged between said control shafts and said gears to activate a selected control shaft and deactivate the other control shaft.

2. A driving mechanism as defined in claim 1, wherein said clutch means are arranged in said guiding cylinder.

3. A driving mechanism as defined in claim 2, wherein said clutch means are arranged around the axis of rotation of the guiding cylinder.

4. A driving mechanism as defined in claim 1, wherein said guiding cylinder is mounted on an axle supported for rotation in a machine frame, and said clutch means being arranged around said axle between said guiding cylinder and said machine frame.

5. A driving mechanism as defined in claim 1, wherein said guiding cylinder is mounted on an axle which is supported for rotation in a machine frame, and said clutch means being arranged on said machine frame eccentrically to said axle.

6. A driving mechanism as defined in claim 1, wherein said clutch means includes a manually operable setting shaft and clutch coupling means for actuating the selected control shaft and arresting the other control shaft.

7. A driving mechanism as defined in claim 6, comprising a gear connected to said setting shaft and a carrier connecting said gear to said clutch coupling means.

8. A driving mechanism as defined in claim 7, wherein said groups of functional elements include a gripper shaft for supporting a set of grippers, gripper control cams connected to respective control shafts, cam followers assigned to respective gripper cams, and a coupler for connecting one of said cam followers to said gripper shaft.

9. A driving mechanism as defined in claim 1, further including a transfer control cam mounted on the control shaft assigned for controlling the printing operation on both sides of the sheets, and means cooperating with said transfer control cam to control the movements of transfer elements on said guiding cylinder.

10. A driving mechanism as defined in claim 9, wherein said transfer elements include suction-type transfer elements and gripper-type transfer elements, and further including a suction control cam arranged on the control shaft for controlling the printing on both sides of the sheets, and pneumatic control means cooperating with said pressure control cam to control the underpressure in said suction-type transfer elements.

11. A driving mechanism as defined in claim 1, wherein the control shaft for controlling printing on both sides of the sheets supports an additional cam for controlling sheet guiding segments on the guiding cylinder.

12. A driving mechanism as defined in claim 8, wherein said gripper controlling cams are arranged on said control shafts.

13. A driving mechanism as defined in claim 7, further including an additional setting shaft and a gear train for coupling said additional setting shaft to said first-mentioned setting shaft.

* * * * *